US006932636B2

(12) United States Patent
Abbey et al.

(10) Patent No.: US 6,932,636 B2
(45) Date of Patent: Aug. 23, 2005

(54) ELECTRICAL PENETRATOR CONNECTOR

(75) Inventors: Stephen Trevor Abbey, Strensall (GB); Rolf August Heinrich Ruesse, Bungerstrasse (DE); Robert Samuel Buchan, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 10/861,998

(22) Filed: Jun. 4, 2004

(65) Prior Publication Data

US 2004/0266240 A1 Dec. 30, 2004

(30) Foreign Application Priority Data

Jun. 5, 2003 (GB) ..... 0312964

(51) Int. Cl.[7] ..... H01R 4/60
(52) U.S. Cl. ..... 439/201; 439/138; 439/271
(58) Field of Search ..... 439/138, 201, 439/271–272

(56) References Cited

U.S. PATENT DOCUMENTS

| | | | | |
|---|---|---|---|---|
| 3,508,188 A | | 4/1970 | Buck | |
| 4,142,770 A | | 3/1979 | Butler, Jr. et al. | |
| 4,174,875 A | | 11/1979 | Wilson et al. | |
| 4,589,492 A | | 5/1986 | Greiner et al. | |
| 4,767,349 A | | 8/1988 | Pottier et al. | |
| 4,859,196 A | | 8/1989 | Durando et al. | |
| 5,171,158 A | | 12/1992 | Cairns | |
| 5,558,532 A | | 9/1996 | Hopper | |
| 5,645,442 A | | 7/1997 | Cairns | |
| 5,722,842 A | * | 3/1998 | Cairns | 439/139 |
| 6,053,253 A | * | 4/2000 | Nicholson | 166/368 |
| 6,237,690 B1 | * | 5/2001 | Nicholson | 166/338 |
| 6,332,787 B1 | | 12/2001 | Barlow et al. | |

FOREIGN PATENT DOCUMENTS

| | | |
|---|---|---|
| EP | 1251598 A1 | 10/2002 |
| GB | 2165284 A | 4/1986 |
| WO | WO 89/07843 | 8/1989 |

* cited by examiner

*Primary Examiner*—Truc Nguyen
(74) *Attorney, Agent, or Firm*—Bracewell & Giuliani LLP

(57) ABSTRACT

An electrical penetrator connector has a fixed coupler pin unit which incorporates a pin having a conductive element. A reciprocatable component includes a housing defining a bore into which the pin may be inserted. Within the bore is a retractable shuttle pin. A chamber contains dielectric fluid. A flow path for the dielectric fluid is configured to move the fluid past a contact in the bore which is to touch the contact on the pin. The dielectric fluid circulates round the flow path every time the pin is inserted into the bore.

20 Claims, 12 Drawing Sheets

ELECTRICAL PENETRATOR CONNECTOR

CROSS-REFERENCE TO RELATED APPLICATION

This application claims the benefit of United Kingdom Patent Application No. 0312964.0, filed on Jun. 5, 2003, which hereby is incorporated by reference in its entirety.

TECHNICAL FIELD OF THE INVENTION

The present invention relates to an electrical penetrator connector, and more particularly relates to an electrical connector which is a "wet mate" connector.

BACKGROUND OF THE INVENTION

Wet mate connectors are used in many underwater applications. For example, reference may be made to underwater vessels such as submarines, and also to underwater remotely operated vehicles (ROVs).

It is envisaged that connectors in accordance with the present invention may be suitable for use in any underwater application, but may be, in particular, suitable for use in an underwater housing assembly of an oil or gas well. It is to be appreciated that electrical connections are often provided in housing assemblies of wellheads to provide high power circuits, which may be used to supply power to items of equipment such as pumps, and also for control and sensor signaling circuits.

Electrical connectors intended for use in an underwater situation, such as in a submarine, ROV or wellhead, must be capable of withstanding the harsh environment to which they will be subjected. Often connections have to be made or un-made whilst parts of the connector are exposed to sea water or well fluid, if the connection is used in an oil or gas well environment. It is important that a connector that forms part of an oil or gas well should be reliable, and should be capable of operating for a long period of time without being serviced, since very substantial expense is incurred in retrieving a connector of this type should a repair be necessary.

The present invention seeks to provide an improved electrical penetrator connector.

SUMMARY OF THE INVENTION

In this invention, the connector has a pin unit having a pin with a pin electrical contact on the exterior of the pin. A receptacle unit that mates with the pin unit has a housing with a bore, the bore having an entrance on an outer end to sealingly receive the pin. The bore defines a shuttle chamber and contains a receptacle electrical contact for electrical engagement with the pin electrical contact. A compensating chamber is connected to the shuttle chamber by a communication passage. Both the compensating chamber and the shuttle chamber contain a dielectric fluid. For the subsea environment, the compensating chamber has a pressure compensator that applies hydrostatic fluid pressure of water surrounding the connector to the dielectric fluid in the pressure compensator. A shuttle member is carried within the shuttle chamber for inward and outward movement relative to the housing. The shuttle member is biased toward an outer position in sealing engagement with the entrance of the bore and moves to an inner position by contact of the pin when the pin unit is coupled to the receptacle unit.

A replenishment valve allows flow through the communication passage from the compensating chamber to the shuttle chamber when pressure in the shuttle chamber is less than pressure in the compensating chamber. The replenishment valve blocks flow through the communication passage from the shuttle chamber to the compensating chamber.

Preferably, a return flow passageway joins the bore adjacent to the receptacle electrical contact. The return flow passageway leads to the compensating chamber. A return valve allows flow of dielectric fluid from the shuttle chamber through the return flow passageway to the compensating chamber when pressure in the shuttle chamber exceeds pressure in the compensating chamber, but prevents flow of dielectric fluid flow through the return flow passageway from the compensating chamber to the shuttle chamber.

Preferably, the pressure compensator comprises an annular main compensation piston and a secondary piston within the compensation piston and movable relative to the compensation piston. The secondary piston applies pressure to the compensating chamber in response to exterior hydrostatic pressure after the main compensation piston has reached an end of a stroke.

Preferably, a desiccant chamber is adjacent to the compensating chamber for containing a desiccant material for contact with the dielectric fluid in the compensating chamber. Also, one embodiment includes a sump recessed within a lower side of the compensating chamber to trap water present in the dielectric fluid.

BRIEF DESCRIPTION OF THE DRAWINGS

In order that the invention may be more readily understood, and so that further features thereof may be appreciated, the invention will now be described, by way of example, with reference to the accompanying drawings in which.

DETAILED DESCRIPTION OF THE PREFERRED EMBODIMENT

The invention will be described with reference to embodiments designed specifically for use with components of a subsea wellhead for an oil or gas well, although the described embodiments may be used in other contexts. Thus, the described components are intended for use at a substantial depth under the surface of the sea and may be expected to be subjected to relatively high sea-water pressure.

Figure 1:
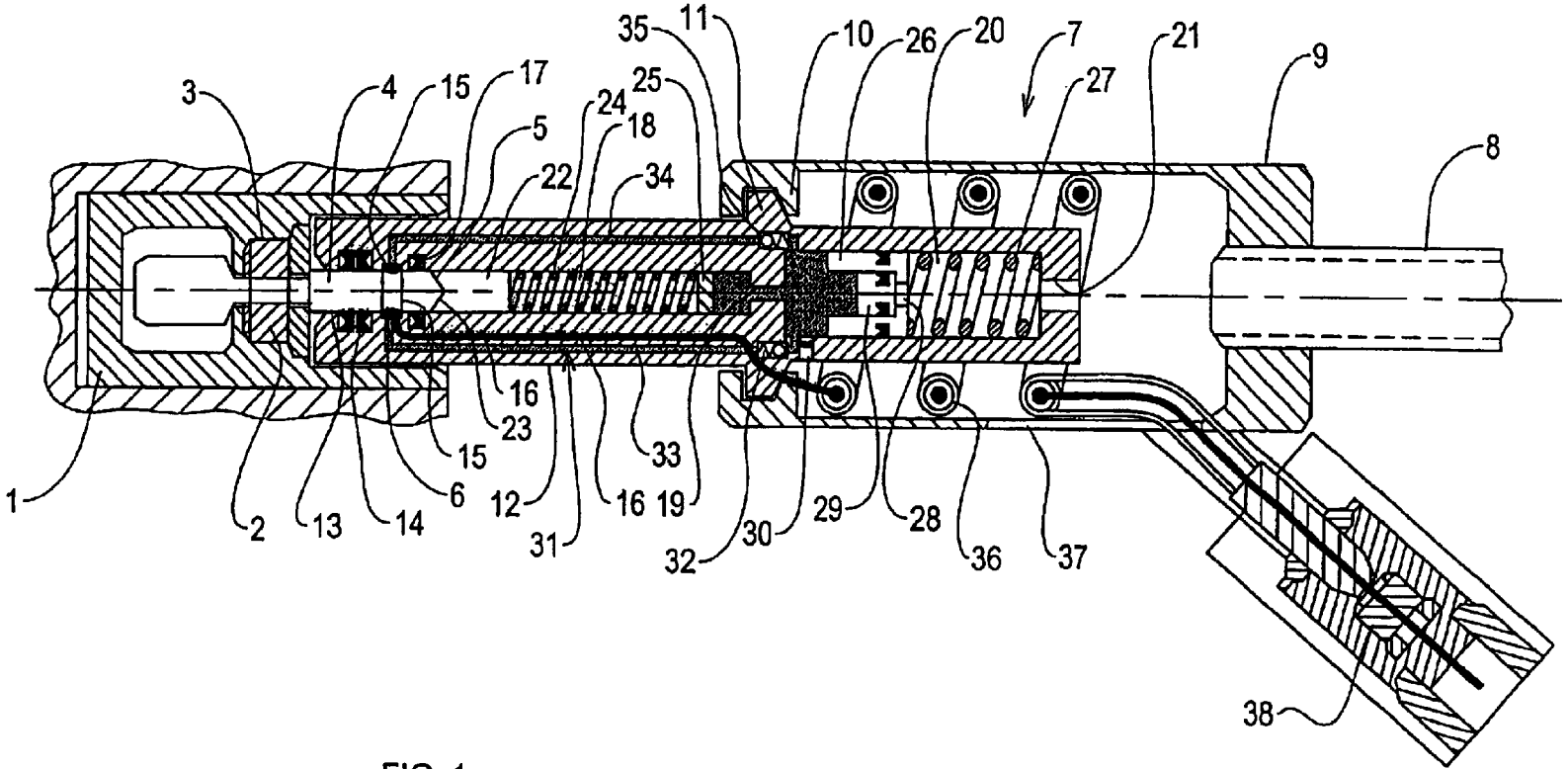
FIG. 1 is a diagrammatic view of one embodiment of a connector in accordance with the invention in a connected condition.

Referring initially to FIG. 1 of the accompanying drawings, a first component in the form of a hanger body 1 forming part of a wellhead is provided with a fixed coupler pin unit 2 which co-operates with a releasable electrical penetrator which will be described in greater detail hereinafter. The fixed coupler pin unit 2 is received within a recess 3 that opens into the sidewall of the hanger body. The fixed coupler pin unit 2 is electrically connected, by means of a connecting arrangement to a coupler within the hanger body that may be coupled to electrical components within a well, such as a pump or a sensor or the like. The coupler pin unit comprises a protruding pin 4 having a tapering or frusto conical tip 5. An electrical contact in the form of an electrically conductive ring 6 is present on the exterior wall of the pin 4 adjacent the frusto conical end, the ring 6 being connected to the connecting arrangement within the hanger body. Such a coupler pin unit is well known in the art.

A receptacle unit 7 is provided in the form of a reciprocatable component. The reciprocatable component 7 can, as will become clearer from the following description, be moved axially to be connected to and disconnected from the coupler pin unit 2 to make or break an electrical connection.

The reciprocatable component 7 is mounted on a hollow actuator stem 8. Any appropriate mechanism may be provided for driving the actuator stem axially to the left or to the right as shown in FIG. 1. The stem 8 is connected to a generally tubular actuation sleeve 9. The sleeve 9 is of tubular form and carries, at its forward end, inwardly directed jaws 10. The jaws 10 engage projections 11 formed on the exterior of a generally cylindrical connector housing 12, which will be described in greater detail below.

The connector housing 12 is an elongate body of cylindrical form being dimensioned, at its forward end, to be received within the coupler pin unit 2.

The forward part of the connector housing 12 defines an axially extending bore 13 having a diameter equivalent to the diameter of the pin 4 of the coupler pin unit 2. An initial part of the bore is provided with a bi-directional seal 14 in the form of two corresponding but mirror-image shaped rubber seal elements each adapted to engage the exterior of an element having a diameter equivalent to that of the pin 4 to effect a seal against the flow of fluid in either direction.

Adjacent the seal 14 the exterior of the bore 13 is provided with an electrical contact in the form of a conductive ring or receptacle15. The conductive ring 15 is connected to an electrical cable 16 that passes through the connector housing 12.

The wall of the bore 13 is provided, on the side of the conductive ring 15 that is remote from the bi-directional seal 14 with a further unidirectional seal 17. The seal 14 is to prevent the flow of fluid past it coming from the area of the conductive ring 15. Alternately, seals 14 and 15 could be configured as in the embodiments of FIGS. 5,6 or 10, with the conductive ring 15 located inward of all of the seals, or seal 17 could be eliminated. The bore 13 continues inward, defining an inner or shuttle chamber 18, which terminates with a constriction or communication passage19. Communication passage 19 leads to a further chamber 20 in the form of a compensation chamber or compensating chamber, the compensation chamber 20 having a greater diameter than the diameter of the shuttle chamber 18. The compensation chamber 20 is provided, at the inner end with a vent port 21. The vent port 21 is at the inner end of the connector housing, which is received within the actuator sleeve 9, and is exposed to hydrostatic pressure of the subsea environment.

Contained within the shuttle chamber 18 is a shuttle member or pin 22 in the form of a cylindrical body, which is a sliding, but not sealing fit within the shuttle chamber 18. The free end of the shuttle pin 22 closest to the open end of the bore 13 is provided with a frusto conical recess 23 configured to co-operate with the frusto conical tip 5 of the pin 4 of the coupler pin unit 2. A spring 24 is contained within the shuttle chamber 18 in engagement with the inner end of shuttle pin 22. The spring 24 has one end engaging the shuttle pin 22 and the other end engaging a floating piston or valve disc 25, which is mounted within the shuttle chamber 18 as a sliding fit. Valve disc 25 need not seal against the side wall of bore 13. Spring 24 biases the valve disc 25 towards communication passage 19. When valve disc 25 moves inward sufficiently from the position shown in FIG. 1, it will contact and block any flow through communication passage 19 into compensating chamber 20. When pin 4 (FIG. 2) contacts and pushes against shuttle pin 22, shuttle pin 22, spring 24 and valve disc 25 move inward. Continued movement of shuttle pin 22 after valve disc 25 contacts communication passage 19 causes spring 24 to compress. The part of the shuttle chamber 18 between the valve disc 25 and the communication passage 19 contains dielectric fluid (shown by the shaded area). The portion of shuttle chamber 18 on the opposite side of valve disc 25 and compensating chamber 20 also contain dielectric fluid.

Here it is to be understood that, in all embodiments of the invention, the dielectric fluid may be any fluid that is an electric insulator, that is to say a fluid that does not support the flow of an electric current. The fluid may be a fluid that flows readily, or, alternatively, may be in the form of a viscous fluid or a thixotropic fluid possessing the properties of a gel. The dielectric fluid is substantially incompressible. Thus, when spring 24 compresses from the position shown in FIG. 1, some of the dielectric fluid contained between valve disk 25 and shuttle pin 22 may escape in a clearance past shuttle pin 22.

Contained within the compensation chamber 20 is a compensating piston 26. The compensating piston 26 is engaged by a compression spring 27 located between the compensating piston 26 and the end of the compensation chamber 20 provided with the vent port 21. The compression spring 27 urges the compensating piston 26 towards the communication passage 19 to apply fluid pressure in compensating piston 26 to shuttle chamber 18 via communication passage 19.

The compensating piston 26 is of complex form and has a body of cup-shape, the base of the cup defining an opening 28. The compression spring 27 engages the base of the cup, and the open mouth of the cup is directed towards the communication passage 19. Contained within the cup is a secondary piston 29, which is in a sliding fit within the side-walls of the cup. The secondary piston 29 is initially adjacent the base of the cup.

Formed in the side-wall of part of the compensation chamber 20 between the compensating piston 26 and the communication passage 19 is a port 30 which is initially closed by means of a burst disc. A burst disc is a disc of material which is intended to rupture of fracture when subjected to a predetermined pressure. Instead of using a burst disc, it would be possible to use a specifically rated non-return valve in the port 30. Thus, when a very high pressure in excess of a predetermined threshold value is present in the compensation chamber 20 the burst disc or non-return valve in the port 30 will permit fluid to escape, thus reducing the pressure. The burst disc or rated non-return valve is optional.

The connector housing 12 defines an internal fluid flow path 31 which effectively commences with a non-return valve 32 which communicates with part of the compensation chamber 20 between the compensating piston 26 and the communication passage 19. The non-return valve leads to a first flow duct 33 which leads to a point adjacent the conducting ring 15 in such a way that fluid may pass towards and into the bore 13 provided in the connector housing 12. A second or return flow duct 34 extends from the region of the conducting ring 15, through another non-return valve 35, back to the part of the compensation chamber 20 located between the compensating piston 26 and the communication passage 19. Valve 35 allows flow into compensation chamber 20, but prevents reverse flow.

It is to be understood that in an initial condition of the apparatus a dielectric fluid will fill the part of the shuttle chamber 18 between the valve disc 25 of communication passage 19, and will fill the part of the compensation chamber 20 between the compensating piston 26 and the communication passage 19 and will also fill the fluid flow paths 32 and 34.

The wire or cable 16 is illustrated emerging from the connector housing 12 at a point adjacent the projection 11. The cable is then present within an insulating sleeve 36 and is wound helically around that part of the connector 12 that defines the compensation chamber 20, before extending through a slot 37 in the actuation sleeve 9 to a dry coupling 38 of conventional form.

Figure 2:
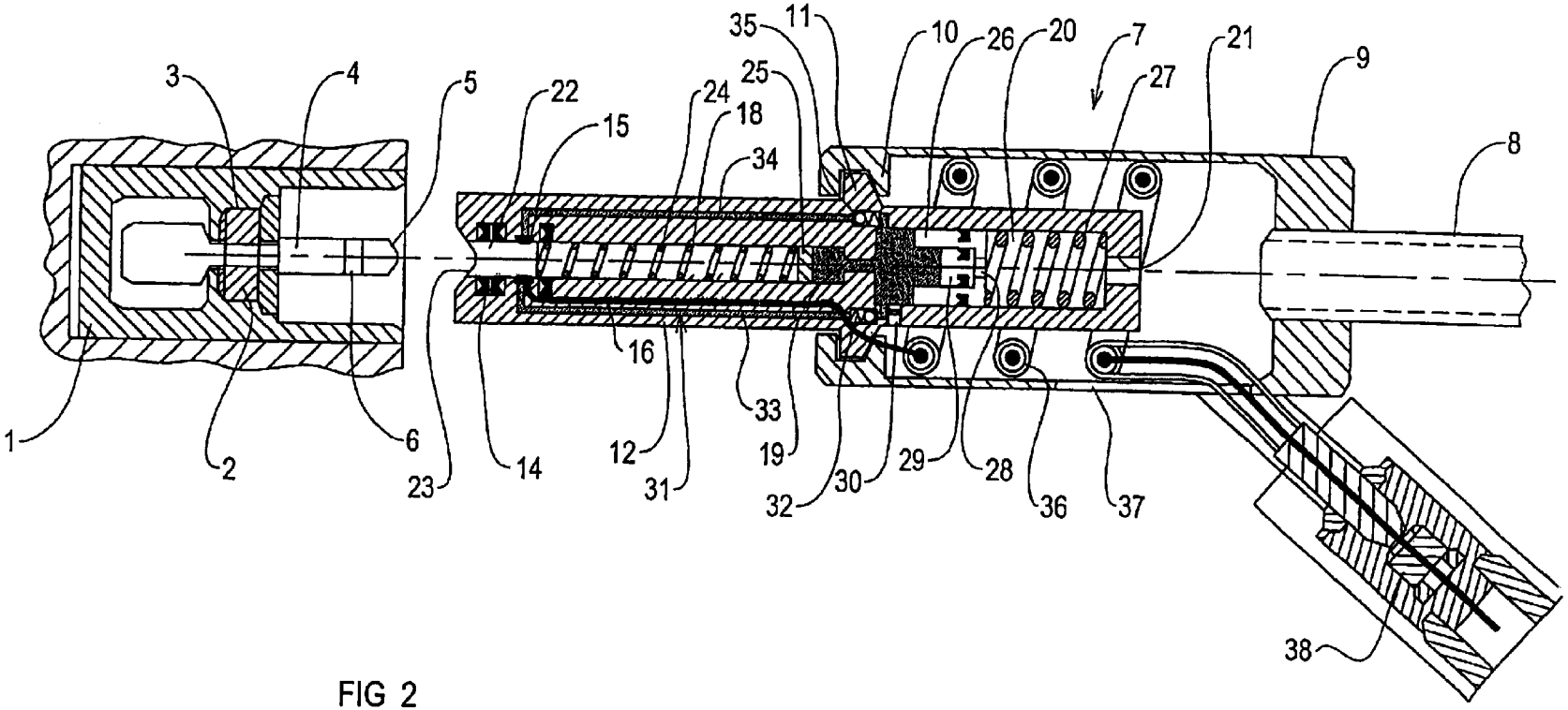
FIG. 2 is a view of the connector of FIG. i in the disconnected condition.

The coupler is shown in FIG. 1 in the connected condition. It is to be appreciated that if a force is applied to the actuator stem 8 tending to move the reciprocatable component 7 towards the right as shown, the forward or left-hand end of the connector housing 12 will become disconnected from the coupler pin unit 2, as shown in FIG. 2. As the connector housing 12 becomes disconnected, the connector pin 4 will be withdrawn from the terminal part of the bore 13. As the pin 4 is withdrawn, the shuttle pin 22 is driven towards the left under the force of the compression spring 18. Thus, as the connector pin 4 is withdrawn from the bore 13, it is effectively replaced by the shuttle pin 22, which has the same outer diameter as the connector pin 4. The combination of the pin and shuttle pin thus pass sequentially between the inner uni-directional seal 17, the conductive ring 15 and the outer bi-directional seal 14. The shuttle pin 22 ceases movement when it is located at the outer end of the bore 13.

When moving to the outer position, the pressure of the dielectric fluid between shuttle pin 22 and valve disc 25 decreases because the volume increases. This lower pressure is communicated to the ports of passages 33, 34 because pin 22 does not seal against those ports. Valve 32 allows dielectric fluid to flow from the higher pressure in compensating chamber 20 through passage 34 in the vicinity of contact 6 to cleanse this area. This flow can enter shuttle chamber 18 on the outer side of disc 25 until the pressure equalizes with that in the compensating chamber 20.

Also, as a consequence of the movement of the shuttle pin 22, the pressure applied to the valve disc 25 by the spring 18 is reduced, allowing valve disc 25 to move in an outward direction, to the left. Thus, the fluid pressure present in the space between valve disc 25 and the restricted diameter communication passage 19 initially reduces because of the viscosity of the dielectric fluid. Dielectric fluid in compensating chamber 20, being at higher pressure, flows through communication passage 19 into shuttle chamber 18 on the inner side of valve disc 25 to replenish the dielectric fluid in this area due to movement of shuttle pin 22 outward. The flow through communication passage 19 pushes valve disc 25 outward, or to the left until equalized.

If the connector housing 12 is then re-introduced to the coupler pin unit 2, as shown in FIG. 1, the connector pin 4 will engage the shuttle pin 22 and will drive the shuttle pin inwardly, thus compressing the spring 18 and pushing valve disc 25 back into blocking engagement with communication passage 19. The connecting pin will return to the position illustrated in FIG. 1. In this position, the electrically conductive ring 6 provided on the pin 4 is in alignment with and in electrical contact with the ring 15 provided in the connector housing 12, thus establishing electrical contact between the components within the well-head and the dry coupler 37.

The entry of pin 4 into shuttle chamber 18 decreases the volume of shuttle chamber 18 for holding dielectric fluid. The displaced dielectric fluid flows through return passage 34 and valve 35 back into compensating chamber 29. After spring 24 has pushed valve disc 25 into contact with communication passage 19, displaced dielectric fluid cannot flow through communication passage 19 back to compensating chamber 20. Displaced fluid can flow around shuttle pin 22 and out return passage 34 back to compensating chamber 20.

It can thus be seen that as connections with the coupler pin unit are successively made and broken, so fluid may be forced into the first flow duct 33 and out of the second flow duct 34, thus creating a fluid flow through the fluid flow path. This fluid flows past the contact ring 15 and will serve to wash away any contaminant present at this point.

As the actuator stem is hollow and since there is a vent port 21 which provides communication to part of the compensation chamber 20 located between the compensating piston 26 and the vent port 21, the compensating piston 26 will be subjected to sea-water pressure in addition to the pressure applied thereto by the spring 27. Thus the pressure applied to the dielectric fluid will always be greater than sea-water pressure, minimizing the risk of ingress of sea water to the described system.

It is to be appreciated that when an arrangement of the type described with reference to FIGS. 1 and 2 is first commissioned, the compensating piston 26 will be located as far as possible from the communication passage 19 so that the part of the compensation chamber 20 between the compensation piston and the communication passage 19 is as large as possible, thus containing a very substantial quantity of dielectric fluid. Should any dielectric fluid be lost from the system, for example by passing through the bi-directional seal 14, the compensating piston 26 will simply move towards the communication passage 19, thus maintaining the integrity of the system and also maintaining the desired pressure levels in the dielectric fluid. Should the compensating piston reach a terminal position, the inner or secondary piston 29 may still continue to move, under the effect of the pressure of sea water applied to the rear face of the secondary piston 29 through the hole 28 formed in the compensating piston 26 to continue this effect.

In the embodiment described with reference to FIGS. 1 and 2, the electrical contact ring 15 is continually and repeatedly flushed with dielectric fluid, thus maintaining good electrical contact with the co-operating ring 6 on the pin 4.

Figure 3:
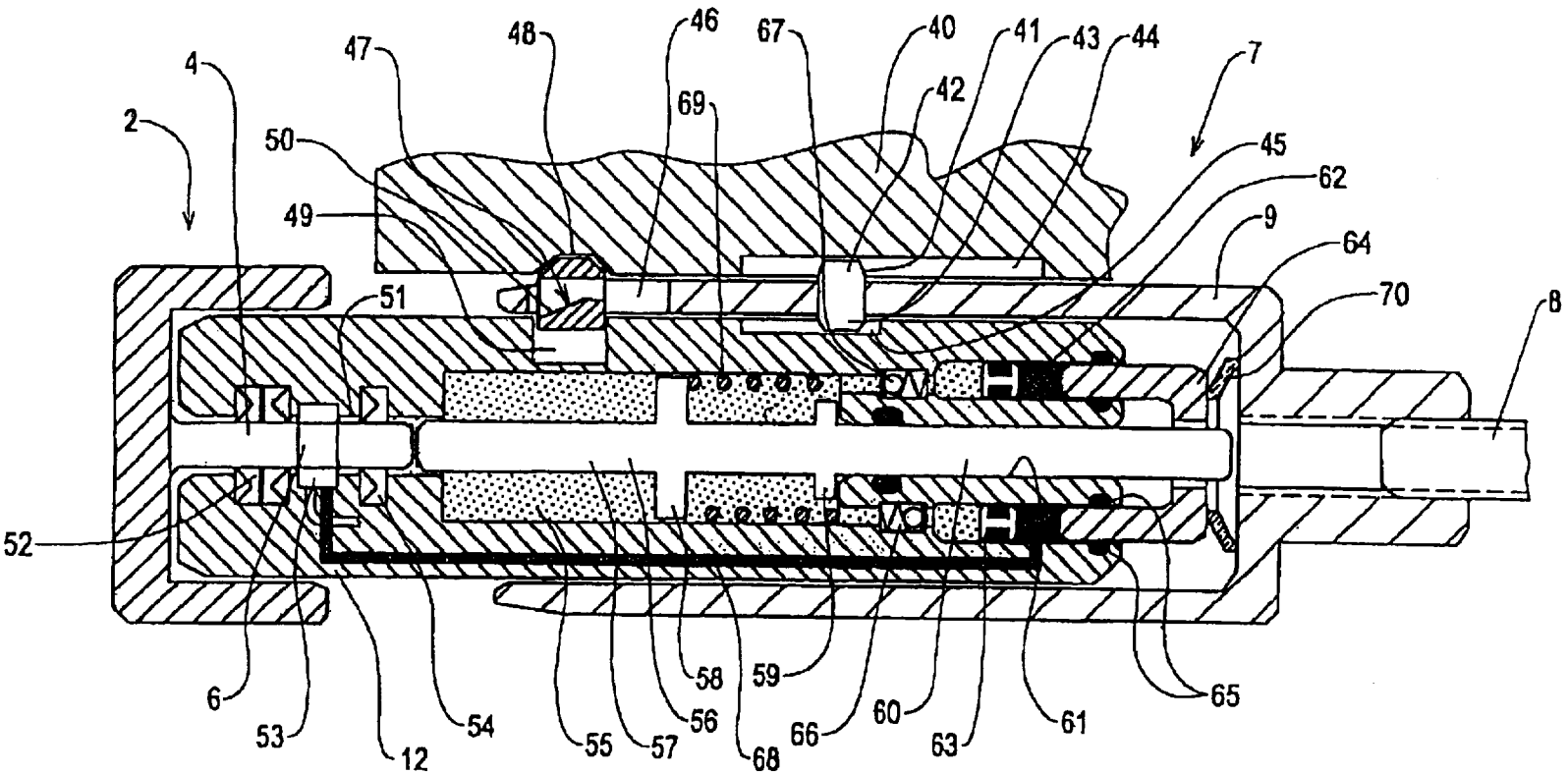
FIG. 3 is a view of a second embodiment of a connector in the connected condition.

FIG. 3 illustrates, in simplified form, an alternative embodiment of the invention. In this embodiment, as in the embodiment described above, there is a coupler pin unit 2 provided with a pin 4 which has an electrically conductive ring 6, as in the coupler pin unit 2 of FIG. 1. Again, in the embodiment of FIG. 3, there is a reciprocatable or receptacle component 7 provided with a hollow actuator stem 8 which acts upon an actuation sleeve 9. Contained within the actuation sleeve 9 is a cylindrical connector housing 12.

In this embodiment the actuation sleeve 9 cooperates with a surrounding bonnet body 40. A central part of the sleeve 9 is formed with a double detent 41 forming an upper or outwardly directed detent portion 42, and inner or downwardly directed detent portion 43. The upper detent portion 41 is received in an axially extending groove 44 formed within an inner part of the bonnet body 40 lying adjacent the exterior of the actuation sleeve. The lower detent portion 43 is received within a corresponding, but shorter groove 45, formed in the exterior of the connector housing 12.

The forward part of the actuation sleeve 9 is provided with an elongate slot 46 which receives a locking dog 47 which can move radially outwardly to engage a locking recess 48 formed in the inner wall of the bonnet housing 40 whilst, part of the dog 47 remains within a recess 49 formed in the exterior wall of the connector housing 12, so that the dog 47 serves to couple or lock the bonnet housing 40 to the actuation sleeve 9. However, the dog 47 may be moved radially inwardly, by moving the actuation sleeve 9 towards the right from the position shown in FIG. 3 to the position shown in FIG. 4. When moved inward, a terminal part of the actuation sleeve engages an internal cam 50 provided within the dog 47 so as to move the dog downwardly from the position shown in FIG. 3, so that the dog is substantially retained within the recess 49 formed in the exterior of the connector housing 12, with the dog thus being disconnected from the recess 48 formed in the bonnet housing 40. When the dog is in the retracted position the actuation sleeve 9, still containing the connector housing 12, may be moved towards the right, relative to bonnet body 40, from the position shown in FIG. 3, with the upper detent portion 41 sliding along the groove 44 formed in the bonnet housing 40. The described arrangement facilitates a movement of the reciprocatable component 7 to effect engagement and disengagement with the coupler pin unit 2.

The connector housing 12 defines an axial bore 51 extending in from the left-hand end of the connector body as illustrated, that is to say the end of the connector body 12 which is brought into engagement with the coupler pin unit 2. The end part of the bore 51 is provided with a bi-directional seal 52 of the type present in the first embodiment of the invention discussed above. Adjacent the bi-directional seal 52 is an electric contact ring 53 associated with a cable corresponding to the ring and cable of the embodiment described above. On the side of the ring 53 remote from the bi-directional seal 52 is a uni-directional seal 54. The seal 54 is configured to permit flow of fluid towards the ring 53 from the interior of the connector body but to prevent the flow of fluid away from the ring 53. Seals 52, 54 could be changed to the seal arrangement of FIGS. 5,6 or 10.

The bore 51 continues into an enlarged diameter chamber 55. Chamber 55 and the portion of bore 51 up to bi-directional seals 52 comprises a shuttle chamber. Contained within the chamber is a shuttle pin 56. The shuttle pin 56 has a left-hand end portion 57 dimensioned to be received as a sliding substantially sealing fit within the bore 51. The tip of the portion 57 is configured to abut with the free end of the pin 4 of the coupler pin unit 2.

The shuttle pin 56 is provided, part-way along its length, with a protruding flange 58 of a diameter slightly less than the diameter of the shuttle chamber 55. The flange is almost a sealing fit within the inner chamber 55, and thus acts almost as a piston head. At a space positioned from the flange 58 a second flange 59 of lesser diameter is provided. The shuttle pin continues with a further portion 60 with the same diameter as the first portion 57, the portion 60 being received within a bore 61 formed in the connector housing 12 at the end thereof which is remote from the end that engages the coupler pin unit 2.

Surrounding the bore 61 is an annular cavity 62 which is open at the end of the connector housing 12 closest to the actuator stem 8. Received within the annular cavity 62 is an annular, freely movable, piston ring 63. The piston ring 63 is a sliding sealing fit within the annular cavity 62. The sealing ring 63 may be provided with rubber "O"-rings to engage the inner and outer walls of the cylindrical cavity 62 to ensure a fluid-tight seal.

A cup-like piston 64 presenting an annular operating surface at the lip of the cup is provided, the piston 64 being configured to be inserted into the open end of the annular chamber 62 to apply pressure, as will be described in greater detail below, to a dielectric fluid (shown by the darker shading) within the chamber 22. Sealing rubber "0" rings 65 may be provided in the walls of the annular chamber 62 to engage with the piston 64 to ensure a fluid-tight seal.

The annular chamber 62 is connected to the inner chamber 55 by means of a first non-return valve 66 which operates in a first sense, to permit fluid to flow from the annular chamber 62 to and by means of a second non-return valve 67 which operates in the opposite sense. Return valve 66 is located in a communication passage between compensating chamber 62 and shuttle chamber 55. The second non-return value 67 preferably opens only at a much higher pressure than the pressure needed to open the first non-return value 66.

A single fluid flow duct 68 is provided which extends from the annular chamber 62, adjacent the piston 64, to the bore 51 in the region of the conductive ring 53. Indeed the conductive ring 53 may be apertured or porous so that the fluid flow duct actually engages with the ring 53.

A helical compression spring 69 is provided located within the main chamber 55 engaging the flange 58 on the shuttle pin 56 which is the flange of greater diameter and also engaging an end wall of the shuttle chamber 55 serving to bias the shuttle pin towards the left as shown, that is to say towards the end of the connector housing that is to be brought into engagement with the coupler pin unit 2.

A further spring 70 is provided, in the form of a resilient washer, (although a helical compression spring may be used) located between the piston 64 and a co-operating part of the actuation sleeve 9, tending to bias the piston 64 into the annular chamber 62.

Figure 4:
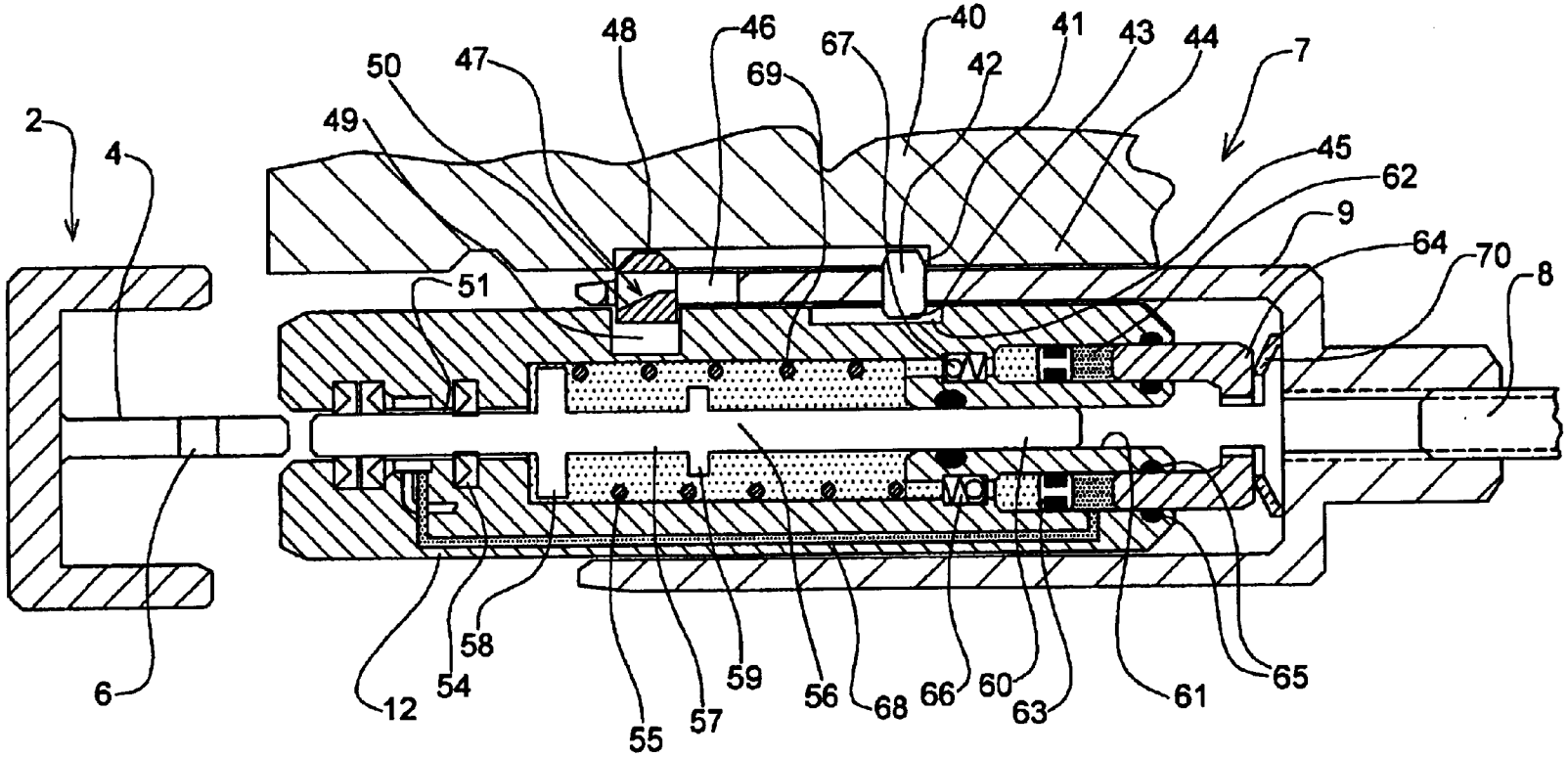
FIG. 4 is a view of the connector of FIG. 3 showing the connector and the disconnected condition.

FIG. 3 illustrates the electrical penetrator connector in the connected or coupled position. Should the connector be disconnected, as shown in FIG. 4, the actuator stem 8 will be manoeuvred so that the connector housing 12 will move towards the right away from the coupler pin unit 2. As the connector housing 12 moves, the pin 4 will effectively be withdrawn from the connector housing 12 and the shuttle pin 56 will be driven outward towards the left, that is to say towards the coupler pin unit 2 by means of the force applied to the flange 58 by the spring 69. The first portion 57 of the shuttle pin will be driven into the bore 51 and the combination of the pin 4 and the first portion 57 of the shuttle pin will move past the uni-directional seal 54 and also past the bi-directional seal 52. This is the situation shown in FIG. 4.

As the shuttle pin 56 moves to the left, the pressure in the dielectric fluid (shown by the dotted shading) contained within the shuttle chamber 55 adjacent the inner end of the bore 51 will rise as a consequence of the piston-like action of the flange 58, thus tending to force some of the fluid to flow through the bore 51 past the conductive ring 53 into a space between the uni-directional seal 54 and the bi-directional seal 52 which contains the conductive ring 53. The fluid will then flow from the space adjacent the ring 53 into the flow duct 68. The fluid will sweep with it any contaminants present in the area of the conductive ring 53.

If fluid is withdrawn from the chamber 55 in this way, make-up fluid may flow from the annular chamber 62 to the left of piston ring 63 through the non-return valve 66 into the shuttle chamber 55. Should this happen the annular ring piston 63 will tend to move towards the left, that is to say towards the non-return valves 66, 67. It is thus to be appreciated that after many cycles of operation, the annular ring piston 63 will have moved a substantial distance, that part of the annular chamber 62 between the annular ring piston 63 and the cup-shaped piston 64 being filled with fluid (shown by the darker shading) which has been swept past the electrical contact ring 53, and which may thus be contaminated. It is to be understood, therefore, that in this embodiment the contaminated fluid is kept separate from fluid which is available for use.

The non-return valve 66 is provided so that, in the event of a very high pressure rising within the shuttle chamber 55 for any reason, fluid may be vented from that chamber into the annular chamber 62 to the left of piston ring 63. If fluid is injected in this way into the chamber 62, the cup-shaped piston 64 may move against the resilient bias provided by the spring 70. Should any fluid be lost from the system, for example by flowing past the bi-directional seals 52, then the cup-shaped piston 64 will act as a compensating piston and will move inwardly, maintaining the integrity of the system, and maintaining the desired pressure in the dielectric fluid. It is to be observed that the actuator stem 8 is hollow and the piston 64 is thus subjected to the pressure of external sea water. Consequently the pressure of dielectric fluid within the system is always in excess of sea water pressure.

When the coupler is re-coupled the described components return to their original positions, with dielectric fluid flowing outward past the flange 58. The conductive rings 6 and 53 are thus brought into contact with each other. The volume of shuttle chamber 55 does not change when shuttle pin 56 moves between inner and outer positions because its inner end 60 always protrudes outward into bore 61, which is exposed to hydrostatic sea water pressure.

Figure 5:
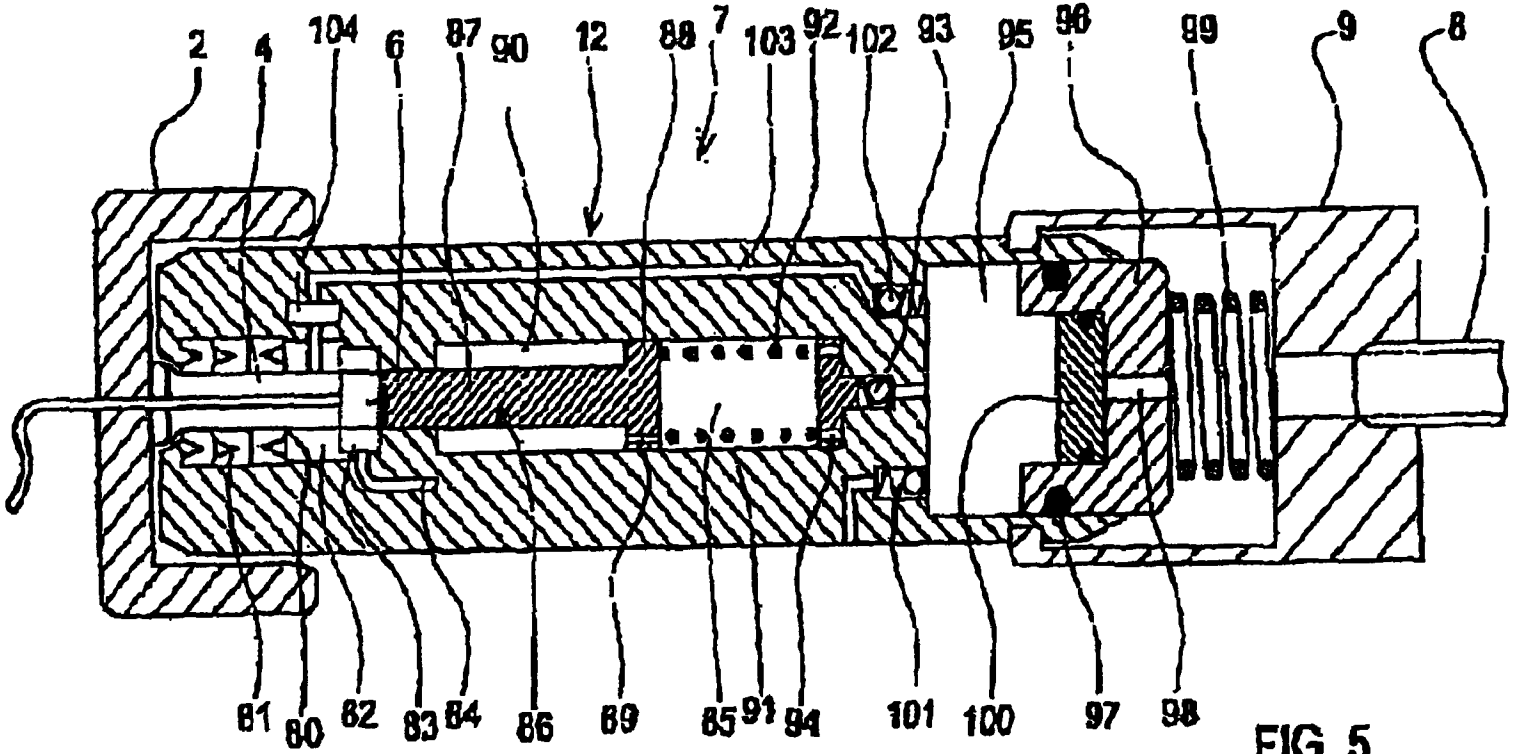
FIG. 5 is a view of a further connector in the connected condition.
Figure 6:
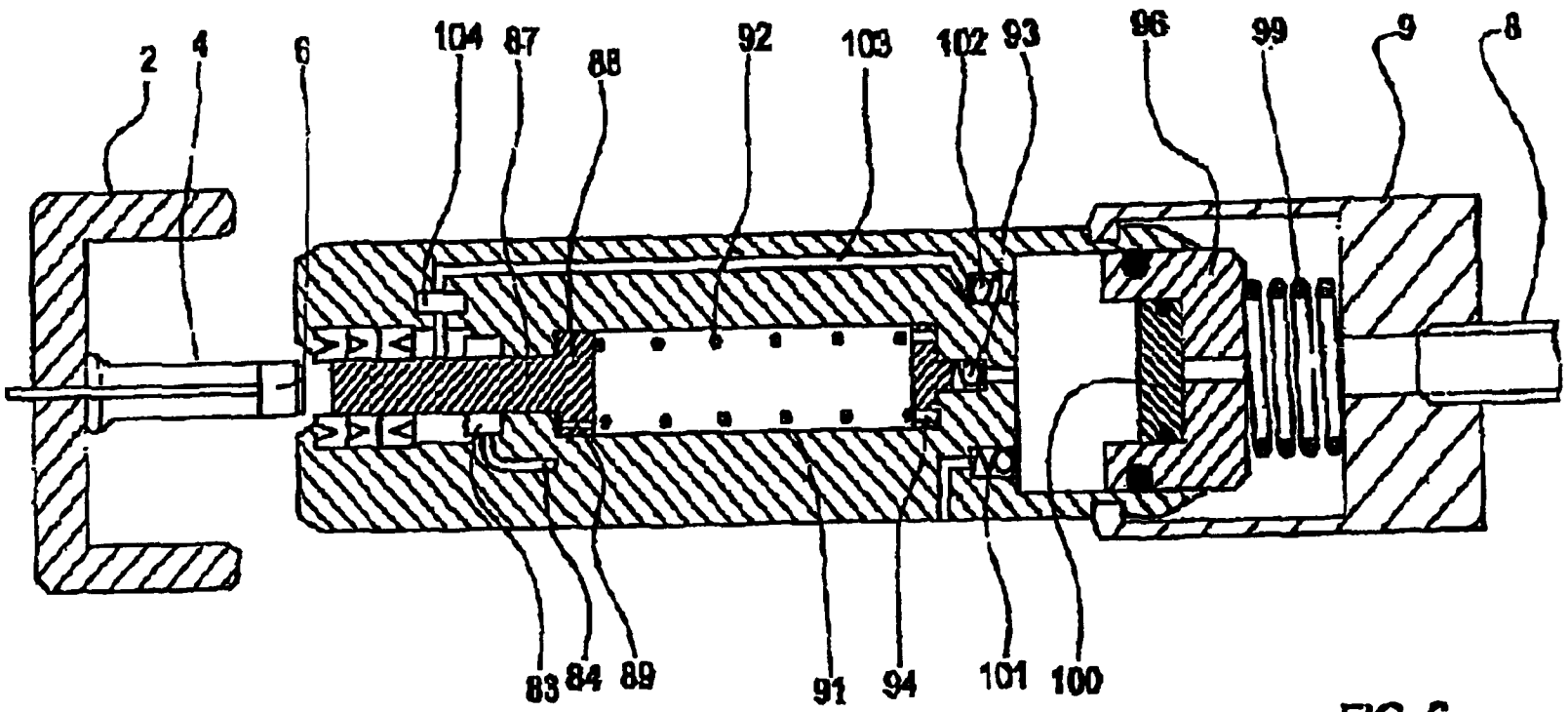
FIG. 6 is a view of the connector of FIG. 5 in the disconnected condition, FIGS. 7*a* and 7*b* comprise a diagrammatic view of yet a further connector in accordance with the invention in a connected condition, with parts being cutaway for the sake of clarity of illustration, FIGS. 8*a* and 8*b* comprise a view of the connector of FIGS. 7*a* and 7*b* in the disconnected condition.

Turning now to FIGS. 5 and 6 a third embodiment of the invention is illustrated. As in the previous embodiments a coupler pin 2 is provided having a pin 4 which has an electrically conductive ring 6.

Again, as in the embodiments described above, the reciprocatable component 7 is provided with a hollow actuator stem 8 which is connected to actuation sleeve 9. Contained within the actuation sleeve 9 is a cylindrical connector housing 12.

The connector housing 12 of the embodiment of FIG. 5 is provided with an axial bore 80 extending from the end of the housing 12 which is to engage with the coupler pin unit 2. Adjacent the free end of the bore 80 are three side-by-side seals 81 that form a bi-directional seal assembly. The innermost seal 81 blocks outward flow from bore 80, while the two outer seals block flow into bore 80. At a distance spaced further inwardly along the bore, and separated by a spacer ring 83, is a conductive ring 83, which is associated with an internal cable 84. The bore 80 then extends into a chamber 85 of larger diameter than the bore 80. Chamber 85 and the portion of bore 80 up to seals 81 comprise a shuttle chamber. The shuttle chamber 85 communicates, by means of a non-return valve 93 in a communication passage, with a cylindrical compensation chamber 95 formed at the end of the connector housing 12 remote from the coupler pin 2, the chamber 95 being open at the end of the connector housing 12. Received within the open end of the compensation chamber 95 is a compensating piston 96 of cup-shaped form, the piston having a sealing "O" ring 97 in its outer wall. The cup-shaped piston 96 defines an opening 98 in its base. The base of the cup-shaped piston 96 is engaged by a compression spring 99 located between the compensating piston 96 and part of the actuation sleeve 9, so that the compensating piston 96 is driven inwardly into the compensation chamber 95. The compensating piston contains a secondary piston 100 which is a sliding fit within the side walls of the cup. The secondary piston 100 is initially adjacent the base of the cup.

An optional pressure relief valve 101 extends from the compensation chamber 95 to the exterior of the connector housing 12. This valve' is to open only at high pressure as an emergency vent.

A return flow passage 103 extends from a point near conductive ring 83 in the wall of housing 12. The outer end of return flow passage 103 leads to a port in spacer 82. An optional chamber 104 may locate in return flow passage 103 for containing a desiccant material.

Contained within the inner chamber 85 is a shuttle pin 86. The shuttle pin has a first cylindrical portion 87 dimensioned to be received as a sliding fit within the bore 80. The cylindrical portion 87 terminates at a radially outwardly directed flange 88, which effectively forms a piston head. A displaced fluid port 89 extends from the inner to the outer side of flange 88. The flange 88 can move axially within the chamber 85 and may effect a sliding sealing fit with the wall of the chamber. A compression spring 92 biases the shuttle pin 86 towards the left as shown in FIG. 5.

It is to be understood that the shuttle chamber 85, the compensation chamber 95 and the return flow duct 103 are all filled with dielectric fluid of the type discussed above.

FIG. 5 illustrates the electrical penetrator connector in the connected or coupled position. Should the connector be disconnected, the actuator stem 8 will be manoeuvred so that the connector housing 12 will move towards the right away from the coupler pin unit 2, as shown in FIG. 6. As the connector housing 12 moves, the pin 4 will effectively be withdrawn from the connector housing 12 and the shuttle pin 86 will be driven towards the left, that is to say towards the coupler pin unit 2, by means of the force applied to the flange 88 by the compression spring 92. As the shuttle pin 86 moves the cylindrical portion 87 of the shuttle pin will be driven further into the bore 80, and the combination of the shuttle pin 86 and the pin 4 of the coupler pin unit 2 will move past the conductive ring 6 and the bi-directional seals 81 until the shuttle pin 86 has the position illustrated in FIG. 6. As the shuttle pin 86 moves, the shuttle pin tends to force dielectric fluid on the outer portion 90 of shuttle chamber 85 past the electrical receptacle 83 and into the return flow passage 103. The fluid passes through the desiccant chamber 104 where any contaminants may be removed from the fluid. The fluid flows into the compensation chamber 95. Some of fluid on the outer portion 90 of the shuttle chamber flows through port 89 in flange 88 as shuttle pin 86 moves outward. Also, pressure is lower in shuttle chamber 85 on the inner side of flange 88 during outward movement of shuttle pin 86. Replenishment fluid, at this time, will flow from the compensation chamber 95 past the non-return valve 93 into that part of the internal chamber 85 which is located on the inner side of the flange 97. The dielectric fluid flowing outward in bore 80 to return flow passage 103 will sweep away any debris or contaminants from the region of the conductive ring 82.

When the penetrator connector is reconnected the pin 4 will tend to push the shuttle pin 96 to the right against the biasing effect of the spring 99. During this movement, fluid will flow through port 89 in flange 88. The electric contact rings 6 and 82 will be brought into contact with each other. The volume of shuttle chamber 85 decreases when pin 4 is inserted into bore 80. Displaced fluid flows through return flow passage 103 back to compensating chamber 95.

The main compensating piston 96 and the secondary piston 100 will operate in a manner equivalent to that of the compensating piston 26 and the secondary piston 29 of the embodiment described with reference to FIGS. 1 and 2.

Should a very high pressure be experienced within the compensation chamber 95, the pressure relief valve 101 will permit some fluid to bleed away, thus reducing the pressure.

Whilst the invention has been described above with embodiments in which the coupler pin unit is provided with a pin 4 which has a single electrically conductive ring 6 which co-operates with a corresponding single electrically conductive ring within the bore of the penetrator housing, it is to be appreciated that embodiments of the invention may be envisaged in which there are a plurality of conductive rings provided on the pin of the coupler pin unit to co-operate with a corresponding plurality of rings provided within the bore of the coupler housing.

The desiccant chamber 104 of FIGS. 5 and 6 could be present in the other embodiments.

The invention will be further described with reference to FIGS. 7 and 8 which show an embodiment designed specifically for use with components of an undersea wellhead for an oil or gas well. Thus, again, the described components are intended for use at a substantial depth under the surface of the sea and may be expected to be subjected to relatively high sea water pressure.

Figure 7A:
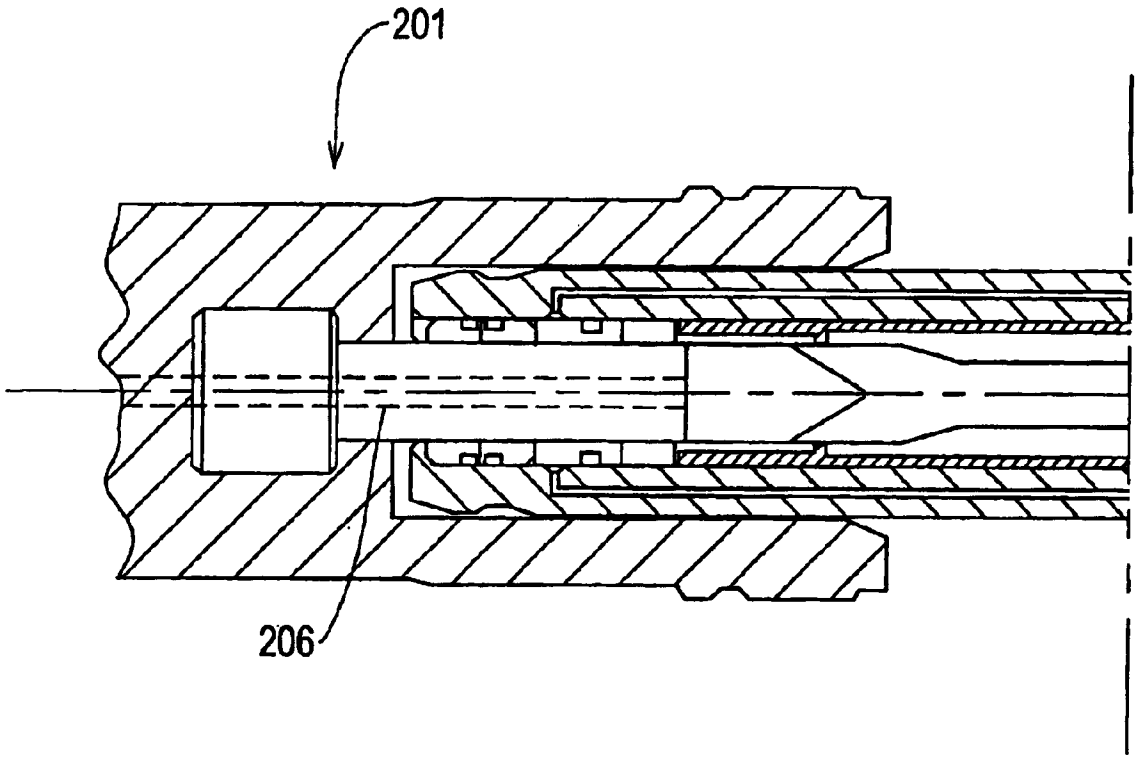
Figure 8A:
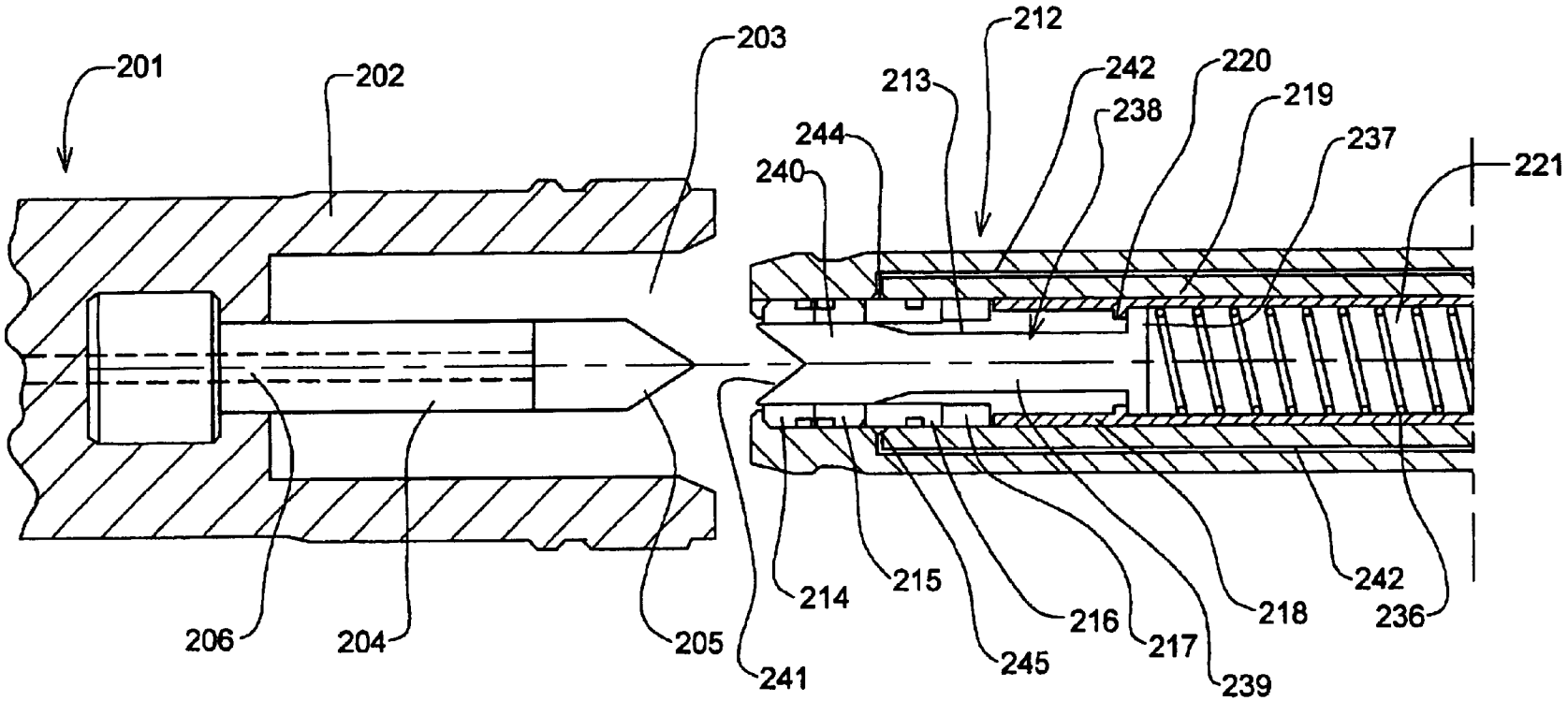

Referring now to FIGS. 7*a* and 8*a*, a first component, in the form of a fixed coupler pin unit 201 is provided which is adapted or configured to be received within a recess formed within a hanger body forming part of a wellhead. The coupler pin unit 201 is to co-operate with a releasable electrical penetrator, which will be described in greater detail hereinafter.

Referring to FIG. 8*a*, the coupler pin unit 201 comprises a body 202 defining a recess 203. A coupler pin 204 extends axially of the recess 203, extending from the base of the recess towards an open mouth of the recess. The coupler pin 204 has an electrically conductive frusto-conical tip 205 which forms an electric contact. An internal cable 206 is connected to this electrically conductive tip.

Figure 7B:
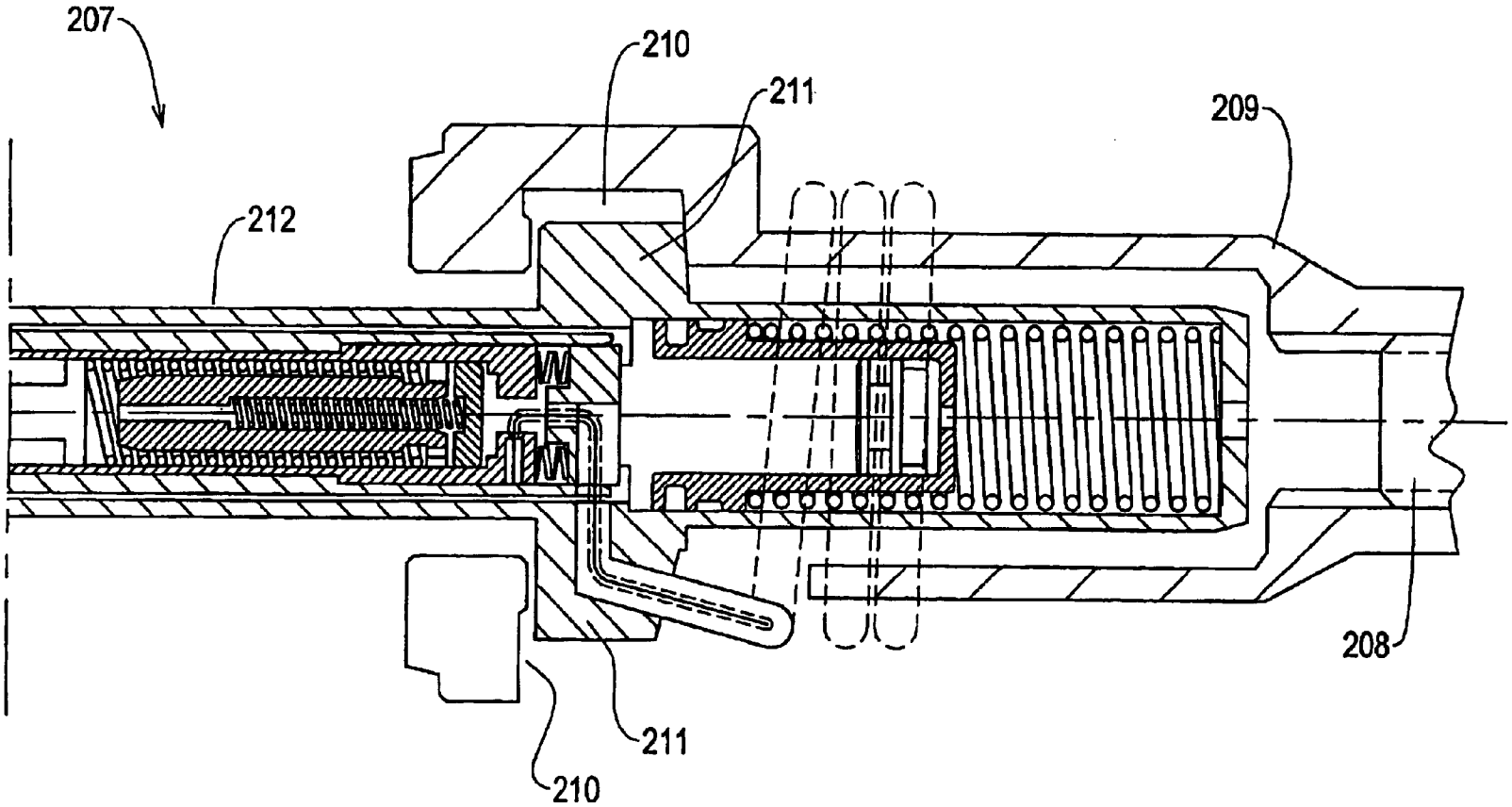

Referring to FIG. 7*b*, to co-operate with the coupler pin unit a reciprocatable receptacle unit 207 is provided. The reciprocatable component 207 can, as will become clearer from the following description, be moved axially to be connected to and disconnected from the coupler pin unit 201 to make or break an electrical connection.

The reciprocatable component 207 is mounted on a hollow actuator stem 208. Any appropriate mechanism may be provided to driving actuator stem axially to the left or right as shown in FIG. 7*b*. The stem 208 is connected to a generally tubular actuation sleeve 209. The sleeve 209 is of tubular form and carries, at its forward end, inwardly directed open jaws 210 (part of the lower jaw is cut-away for the sake of illustration). The jaws 210 engage projections 211 formed on the exterior of a generally cylindrical connector housing 212, which will be described in greater detail below.

Referring to FIG. 8*a*, the connector housing 212 is an elongate body of cylindrical form being dimensioned, at its forward end, to be received within the recess 203 of the coupler pin unit 201.

A forward part of the connector housing 212 defines an axially extending bore 213. An initial part of the bore is provided with an outer seal formed by three adjacent sealing elements 214, 215, and 216, each being a unidirectional seal. The inner portions of the seal 214, 215, 216 define a diameter which is equivalent to the diameter of the pin 204 of the coupler unit 201. The seals 214, 215 closest to the end of the bore 213 are oriented to prevent the ingress of fluid from the exterior of the bore, whereas the inner seal 216 is oriented to prevent the escape of fluid from within the bore. Seals 214, 215, 216 are essentially the same as the seal assemblies shown in FIGS. 5, 6 or FIG. 10.

Adjacent the seals 214, 215 and 216 is an annular spacer 217. Adjacent spacer 217, further towards the interior of the connector housing 212, a terminal part 218 of an electrically conducting sleeve 219 which may, for example, be formed of copper or copper alloy is aligned with the seals. The terminal part 218 of the conducting sleeve 219 may be provided with a plurality of resiliently inwardly biased contact elements configured (as will be explained in greater detail below) to establish electrical contact with the electrically conducting tip 205 of the coupler pin 204 of the fixed coupler pin unit 201. The configuration of the contact elements is such that a fluid may flow axially past the contact elements. The terminal part 218 of the sleeve 219 terminates with an inwardly directed collar 220 located between the terminal part of the sleeve, and the main part of the sleeve.

Figure 8B:
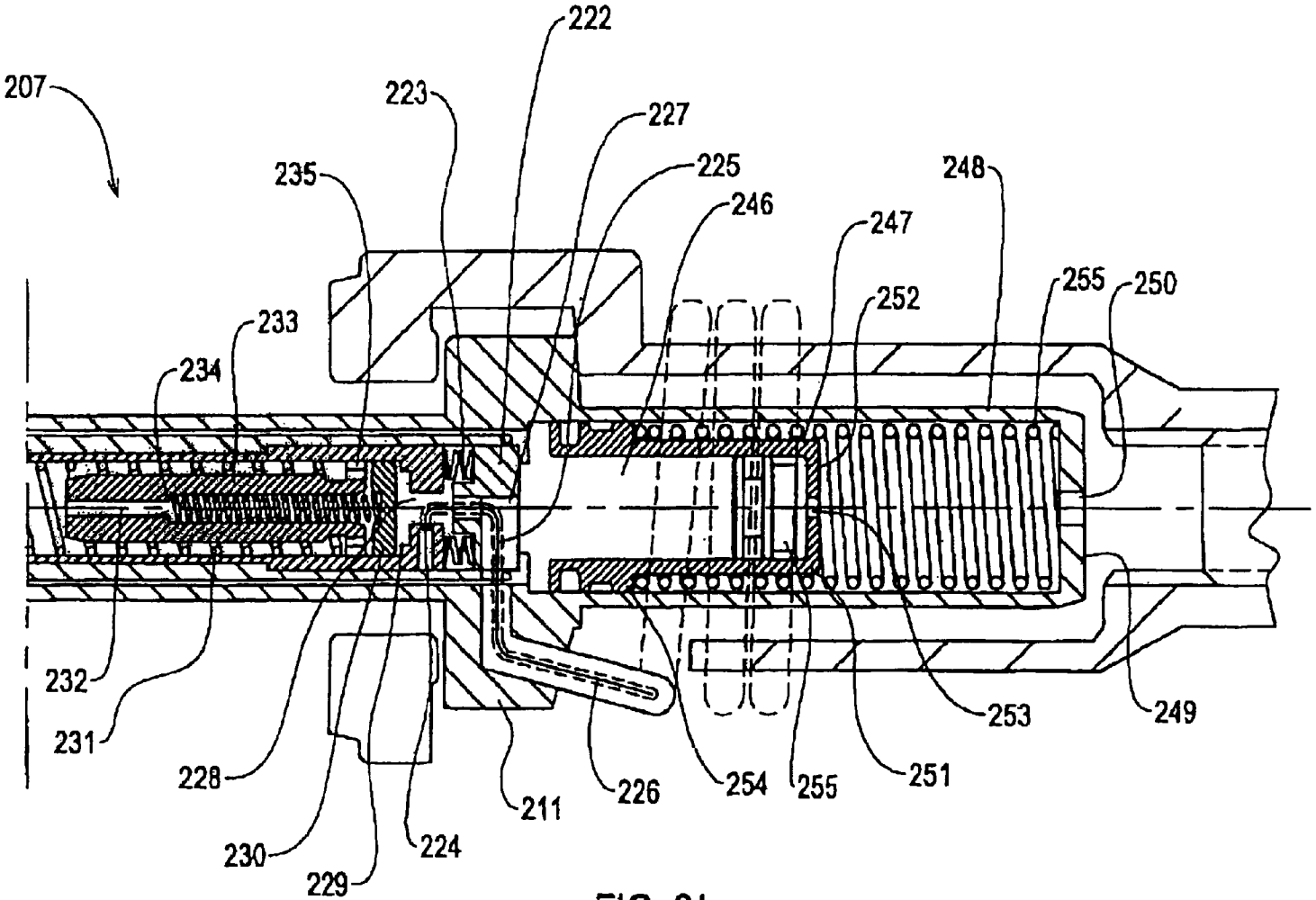

Referring to FIG. 8*b*, the sleeve 219 and the seals described above are all received within a cylindrical cavity 221 present within the connector housing 212. The cavity 221 is closed, at its inner end, by means of a plug 222. The plug 222 is associated with packing elements 223 located between the plug 222 and the innermost end of the electrically conducting sleeve 219. The innermost end of the electrically conducting sleeve 219 (FIG. 8*a*) is provided with an electrical termination 224, which is connected to a conductor 225 present within a cable 226. The cable extends from the terminator 224 through an aperture 227 formed within the plug 222, the cable then passing out through one of the projections 211 provided on the connector housing 212.

The end of the electrically conducting sleeve 219 adjacent the plug 222 defines an aperture or communication passage 228 through which a fluid may flow. With the conducting sleeve 219, adjacent the aperture a valve seat 229 is formed which cooperates with a non-return valve member 230. The non-return valve member is in the form of a disc adapted to engage the seat 229. Extending from the center point of the disc 230 is a guide stem (not visible in the figures), the guide stem being surrounded by a helical compression spring 231.

The guide stem and compression spring extend into a bore 232 formed within an inner cylindrical guide element 233 which is received within a chamber defined between the non-return valve 230 and the shoulder 220 of the conducting sleeve 219. The spring 231 engages a shoulder 234 formed part-way along the bore 232.

The guide element 233 is of cylindrical form, having an outer diameter which is less than the internal diameter of the electrically conducting sleeve 219, the axis of the guide element 233 being co-aligned with the axis of the electrically conducting sleeve 219. At the end of the guide element 233 adjacent the non-return valve member 230, a flange comprising a plurality of radially outwardly directed arms 235 (seen most clearly in FIG. 9) is provided to secure the guide element in position whilst defining fluid flow passages for fluid to flow past the guide element.

A shuttle pin biasing spring 236 is mounted within the chamber formed in the main part of the electrically conducting sleeve 219, the spring 236 being dimensioned to surround, at one end thereof, the guide element 233 and to engage the radially outwardly directed arms 235. The other end of the shuttle pin biasing spring 236 engages an enlarged diameter end portion 237 formed at one end of a retractable shuttle pin 238, as shown in FIG. 8*a*. The end portion 237 has a diameter greater than the internal diameter of the collar 220. The enlarged diameter end portion 237 may be formed by a plurality of angularly spaced-apart radially outwardly extending fingers formed at the end of a shank 239, the shank having a diameter less than the internal diameter of the seals. At the other end of the shank 239 is an engagement formation 240, the engagement formation having a diameter equal to that of the coupler pin 204 and equivalent to the internal diameter of the seals 214, 215 and defining, at its free end, a recess 241 configured to receive the frusto-conical electrically conducting tip 205 of the coupler pin 204 of the fixed coupler pin unit 201. The outer diameter of the engagement formation 240 is thus such that it establishes a sliding sealing fit with each of the seals 214, 215 and 216 as described above.

Figure 10:
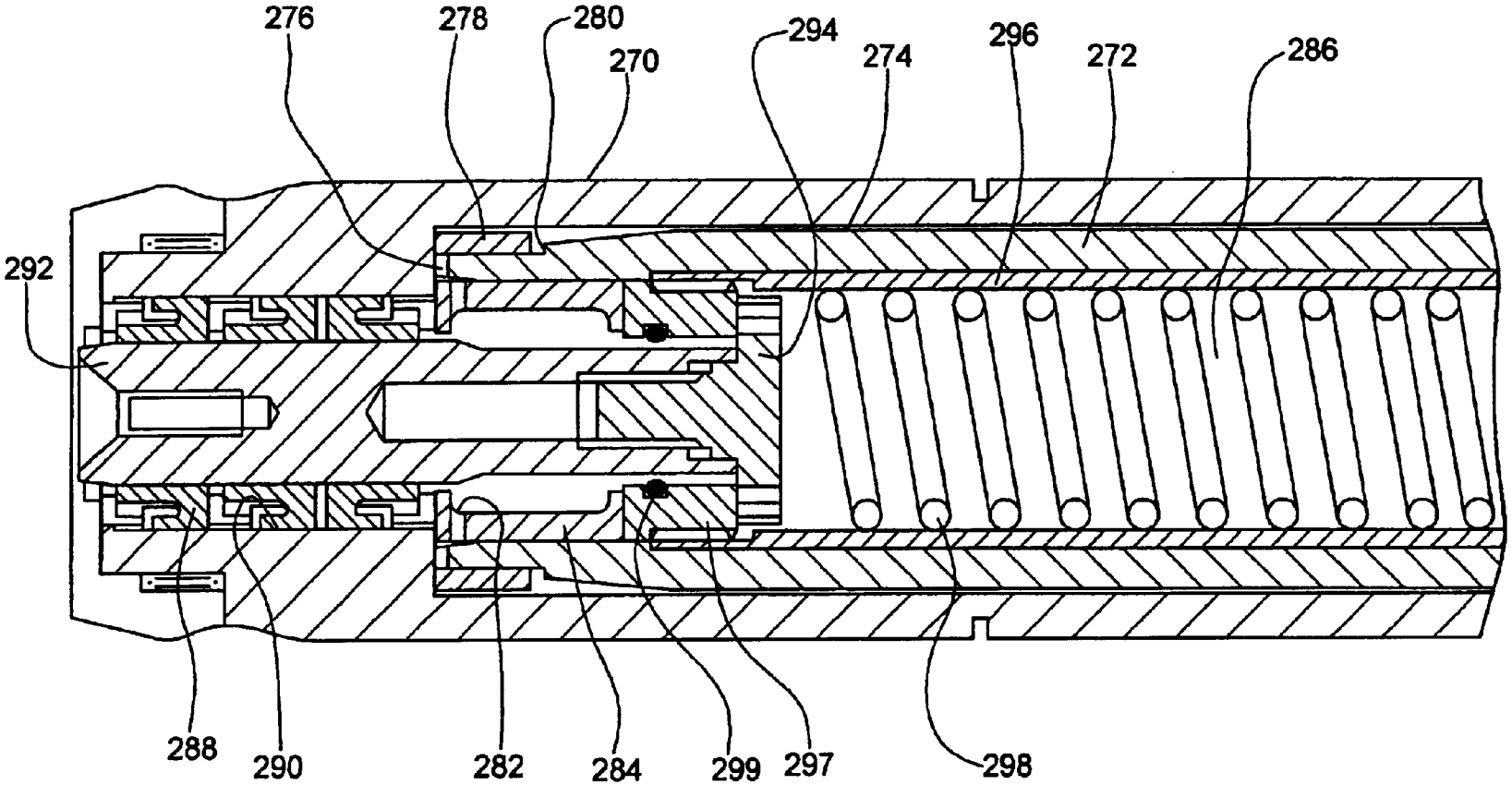
FIG. 10 is a view on an enlarged scale of another portion of a modified connector similar to that of FIGS. 7 and 8.

Formed within the connector housing 212 is an annular clearance or return passageway 242 formed by two spaced apart sleeves (not shown). These sleeves form the wall of the part of connector housing 212 that surrounds the shuttle chamber 221 which accommodates the electrically conductive sleeve 219. The passageway 242 extends from a plurality of ports 244, 245 adjacent spacer 217. A check valve (not shown) is preferably located in passageway 242 to prevent flow of fluid from compensating chamber 247 to ports 244, 245, but allow flow in the reverse direction. FIG. 10 shows an example of a check valve. Inner seal 217 has passages through it to communicate with ports 244, 245.

Referring to FIG. 8*b*, the reservoir or compensation chamber 247 is defined by a generally hollow cylindrical housing 248, one end 249 of which is closed by an end wall, the end wall having a compensation aperture 250 formed in it.

Contained within the generally cylindrical housing 248 is a compensating piston unit 251, the piston unit itself being of generally tubular or cup-shaped form, having a closed end 252 with a further compensation aperture 253. Adjacent an open end of the main compensating piston 247 there is an outwardly directed flange 254 which may be provided with an "0" ring seal so it is a sliding sealing fit within the interior of the hollow cylindrical housing 248. A compression spring 255 engages the flange 254 and also engages the closed end 249 of the generally tubular housing 248 to bias the compensating piston unit 247 towards the plug 222 associated with the cable 226.

It is to be understood, therefore, that the compensating piston 247 has a tubular body of cup-shape, with the base of the cup defining the compensating opening 253. Contained within the tubular body of the compensating piston 247 is a secondary piston 255, which has a sliding sealing fit in the main compensating piston 247.

It is to be understood that initially the compensation chamber or reservoir 246 and the chamber defined between the non-return valve 230 and the shoulder 220 of the conductive sleeve 219 are filled with dielectric fluid. The dielectric fluid will also fill the space surrounding the shank 239 of the retractable shuttle pin and the fluid flow passageway 242 (FIG. 8*a*). The quantity of dielectric fluid present initially will be such that the main compensation piston 247 will be moved almost fully towards the right within the cylindrical housing 248, substantially compressing the spring 255. Typically the dielectric fluid is initially under a pressure of approximately 2 bar.

FIGS. 7*a*, 7*b* illustrate the connector in the connected position. If the connector is to be disconnected the reciprocatable component 207 will be moved towards the left as shown in FIGS. 7*a*, 7*b*. Referring to FIGS. 8*a*, 8*b*, as the connector housing 212 moves towards the left so the biasing force applied to the retractable shuttle pin 238 by the shuttle pin drive spring 236 will cause the shuttle pin to move towards the left as shown in FIG. 7. The combination of the terminal part of the connector pin 204 of the fixed pin unit 201, and the engagement formation 240 provided at the end of the shank 239 of the retractable shuttle pin 238 will move, together, outward past the innermost seal 216. Since the outer diameter of the engagement formation 240 and also the outer diameter of the connector pin 204 are each equal to the diameter of the bore formed by the seals, the seals make a sealing sliding fit to prevent the egress of dielectric fluid.

As the retractable shuttle pin 238 moves towards the left, the shuttle pin is effectively withdrawn from the chamber defined between the non-return valve 230 and the collar 220. Effectively the internal volume of the shuttle chamber is reduced and the pressure of dielectric fluid within the shuttle chamber falls. The pressure within the reservoir or compensation chamber 246 is maintained by the action of the spring 255. Thus the non-return valve 230 (FIG. 8*b*) is opened, compressing the spring 231 contained within the bore 232 of the guide element 233. Dielectric fluid, within the compensation chamber or reservoir 246 flows through the communication passage 227 formed in the plug 222 and also through the aperture 228 formed in the end of the electrically conducting cylinder 219 adjacent the electrical termination 224. The non-return valve 230 is spaced from the co-operating seat 229, permitting the dielectric fluid to flow into the chamber.

Referring to FIG. 8*a*, the movement of the shuttle pin 238 towards the left is terminated when the large diameter end portion 240 provided on the shuttle pin 238 engages the shoulder 220 present in the electrically conducting sleeve 219. During this process the compensation piston 247 will move towards the left, under the influence of the compression spring 255, thus compensating for the dielectric fluid which has passed from the reservoir or compensation chamber 246 into the chamber between the non-return valve 230 and the collar 220.

When the connector again makes a connection the reciprocatable component 207 (FIG. 7*b*) is moved towards the fixed coupler pin unit 201 (FIG. 7*a*) until the frusto-conical conductive tip 205 (FIG. 8*a*) is received within the co-operating recess 241 provided in the engagement formation 240 provided at the end of the retractable shuttle pin 238.

Continued movement of the reciprocatable component 207 will cause the retractable shuttle pin 238 to be driven towards the right, into the chamber 221. Effectively the volume of the shuttle chamber 221 is thus reduced and consequently pressure within the dielectric fluid within the shuttle chamber will rise. The non-return valve 230 (FIG. 8*b*) will become firmly closed, with the non-return valve 230 being pressed securely into engagement with the seat 229. Continued inward movement of the retractable shuttle pin 238 will tend to further increase the pressure of dielectric fluid by further reducing the internal volume of the shuttle chamber 221, and the fluid will then flow between the radially outwardly directed fingers forming the enlarged diameter end region 237 (FIG. 8*a*) and past the sides of the relatively narrow shank 239, flowing past the seal 216 which is configured to make a sealing engagement with the engagement formation 240 provided at the end of the shank 239 which, it is recalled, has a larger diameter than the diameter of the shank. The fluid flows past the electric contacts provided in the terminal region 219 of the electrically conducting sleeve 220, sweeping away any contaminants and thus ensuring that this region is clean and will make a good electric contact. The fluid flows through the ports 244, 245 and through the return flow passageway 242 into the reservoir or compensation chamber 246, causing the compensation piston 247 to move to the right against the bias of the spring 255. The fluid will not flow past the outer seals 214, 215.

As the coupler pin 204 (FIG. 8*a*) of the coupler pin unit 201 effectively moves further into the interior of the connector housing 212, fluid continues to flow, flowing through the circulation path constituted by the passageway 242. Fluid continues to flow, consequently, until the coupler pin 204 is in the fully inserted position shown in FIG. 7*a* in which the electrically conductive frusto-conical tip 205 is in engagement with the contacts provided at the end of the electrically conducting sleeve 219 (FIG. 8*a*).

The described apparatus is then ready to repeat the above-described cycle of operation. It is inevitable, even though high quality seals may be provided, that at each make-and-break of the connector some of the dielectric fluid will escape past the seals and be lost. As the quantity of dielectric fluid within the described arrangement is reduced the compensation piston 247 will be gradually driven towards the left, as shown in FIG. 8*b*, under the effect of the spring 255. Should a situation arise in which the flange 254 provided on the main compensation piston 247 should engage with the innermost end wall of the cylindrical housing 248 adjacent the plug 222, the inner valve disc 255 may move within the main compensation piston 247 in response to pressure applied thereto by sea water, the sea water passing through the hollow stem 8, the compensation aperture 250 formed in the end of the cylindrical housing 248 and the further compensation aperture 253 formed in the end wall 252 of the main compensation piston 247.

Figure 9:
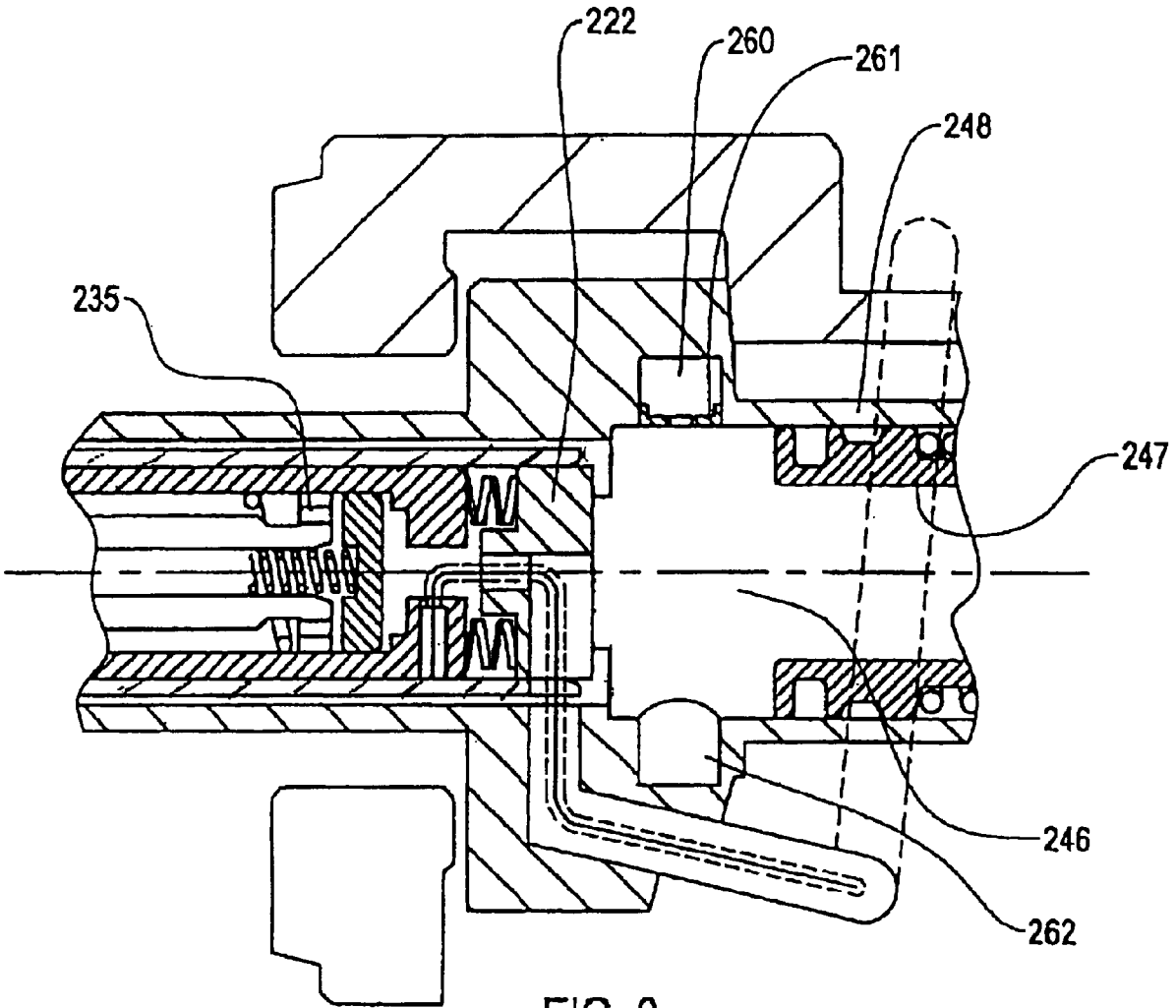
FIG. 9 is a view on an enlarged scale of part of a modified connector similar to that of FIGS. 7 and 8.

FIG. 9 shows a modified embodiment of the invention. In this embodiment of the invention the end of the cylindrical housing 248, between the innermost end of the main compensation piston 247 and the plug 222 is enlarged and modified. A first chamber 260 is provided in the upper part of the cylindrical housing 248. The chamber 260 is closed by means of a plug 261, whilst still communicating with the compensation chamber or reservoir 246. The chamber 260 may contain an appropriate desiccant such as, for example, dried silica gel.

The lower-most part of the cylindrical housing 248, at a position directly opposed to that of the chamber 260, is provided with a recess or well 262, which again communicates with the compensation chamber or reservoir 246. The well 262 is located in such a position that if there is any water entrained with the dielectric fluid, the water will tend to accumulate within the well 262. It is believed that the combination of the chamber 260 containing desiccant and the well 262 to trap water will ensure that the dielectric fluid is, effectively, water-free and retains appropriate dielectric properties.

FIG. 10 shows the forward end portion of a housing 270 of a receptacle unit. A concentric sleeve 272 is carried in housing 270. The outer diameter of sleeve 272 is less than the inner diameter of housing 270, creating an annular return passageway 274 that allows dielectric fluid flow in an inward direction. Return passageway 274 communicates with an inlet port 276 at the end of sleeve 272. A valve 278 comprising a ring is slidably carried on the end of sleeve 272. In the closed position shown, valve 278 blocks flow from return passageway 274 into inlet port 276. In the open position, not shown, valve 278 slides inwardly into contact with a shoulder 280 on sleeve 272, allowing flow of dielectric fluid outward from passageway 274 into inlet port 276. Valve 278 has an outer diameter less than the inner diameter of housing 270, allowing flow of dielectric fluid inwardly through return passageway 274.

Inlet port 276 communicates with a port 282 in a spacer ring 284. Port 282 leads to a bore 290, which is a forward end portion of a shuttle chamber 286. A set of seals 288 are located at the entrance to bore 290, seals 288 being similar to the seals in the embodiments of FIGS. 5-6 and 7–9. The innermost of seals 288 is located outward from port 282 and blocks outward flow of fluid in bore 290. The two outward seals 288 block inward flow of fluid into bore 290.

A shuttle pin 292 reciprocates in bore 290 and shuttle chamber 286. Shuttle pin 292 is configured generally as in the embodiment of FIGS. 7–9, having an enlarged diameter outer end and a flange 294 on the rearward end. Flange 294 is slidingly carried in an electrically conductive sleeve 296 located within sleeve 272 in shuttle chamber 286. Flange 294 has passages from its inner side to its outer side for the passage of dielectric fluid. A conductive ring 297 is secured to and becomes part of the outer end of conductive sleeve 296. Conductive ring 297 has an inner diameter sized for receiving the electrical contact of the pin (not shown) and a seal 299 in its inner diameter that seals against the electrical contact of the pin. A spring 298 biases shuttle pin 292 to the outer position shown in FIG. 10. The pin unit (not shown) and the remaining portions of the receptacle unit are preferably constructed generally as shown in FIGS. 7–9.

In the operation of the FIG. 10 embodiment, during connection, the pin (not shown) of the pin unit pushes shuttle pin 292 inwardly until the pin electrical contact engages electrical receptacle 297. The volume of shuttle chamber 286 decreases when this occurs. Displaced dielectric fluid in shuttle chamber 286 flows through ports 282 and 276 and pushes valve 278 inward to open return passageway 274. Prior to opening, the pressure in passageway 274 would be substantially the same as in the compensating chamber (not shown), which is lower than the pressure caused by the displaced fluid in shuttle chamber 286. Fluid flows back into compensating chamber until the pressure equalizes, cleansing conductive ring 297 while doing so. After the enlarged portion of shuttle pin 292 enters conductive ring 297, no more dielectric fluid will flow from shuttle chamber 286 to return passage280 even though valve 280 remains in the open position.

When disconnected, spring 298 pushes shuttle pin 292 outwardly, creating a reduced pressure in shuttle chamber 286. This pressure reduction causes dielectric fluid to flow into the inner end (not shown) of shuttle chamber 286 through a valve similar to valve 230 of FIG. 8*b*. At this point, the pressure in the compensating chamber (not shown) is higher than in shuttle chamber 286, and this higher pressure is communicated to return passageway 274 from the inner end of return passageway 274. The higher pressure causes valve 278 to slide outward to the closed position of FIG. 10, preventing any flow of dielectric fluid from return passageway 274 into shuttle chamber 286. The arrangement of FIG. 10 could be employed with the embodiments of FIGS. 5-9.

Whilst the invention has been described with reference to embodiments in which there is a single coupler pin in the coupler pin unit and a single reciprocatable shuttle pin within a single bore, it is envisaged that it will be practicable to produce embodiments in which there are a plurality of coupler pins and a plurality of bores each containing a respective retractable shuttle pin, to co-operate with the plurality of fixed coupler pins. In such an arrangement the fluid flow passages associated with each bore may communicate with a common compensation chamber or reservoir for dielectric fluid. However, to ensure an appropriate flow of fluid in each bore it may be necessary for the passageways to be provided with appropriate flow control valves.

In the present Specification "comprises" means "includes or consists of" and "comprising" means "including or consisting of".

The features disclosed in the foregoing description, or the following Claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A subsea electrical connector comprising:

a pin unit having a pin with a pin electrical contact on the exterior of the pin;

a receptacle unit having a housing with a bore, the bore having an entrance on an outer end to sealingly receive the pin, the bore defining a shuttle chamber;

a receptacle electrical contact in the bore for electrical engagement with the pin electrical contact;

a dielectric compensating chamber connected to the shuttle chamber by a communication passage, the compensating chamber and the shuttle chamber adapted to contain a dielectric fluid, the compensating chamber having a pressure compensator that applies hydrostatic fluid pressure of water surrounding the connector to the dielectric fluid in the pressure compensator;

a shuttle member carried within the shuttle chamber for inward and outward movement relative to the housing, the shuttle member being biased toward an outer position in sealing engagement with the entrance of the bore and being moved to an inner position by contact of the pin when the pin unit is coupled to the receptacle unit; and a replenishment valve that allows flow through the communication passage from the compensating chamber to the shuttle chamber when pressure in the shuttle chamber is less than pressure in the compensating chamber, the replenishment valve blocking flow through the communication passage from the shuttle chamber to the compensating chamber.

2. The connector according to claim 1, further comprising:

a return flow passageway joining the bore adjacent to the receptacle electrical contact and being in fluid communication with the compensating chamber; and a return valve that allows flow of dielectric fluid from the shuttle chamber through the return flow passageway to the compensating chamber when pressure in the shuttle chamber exceeds pressure in the compensating chamber, but prevents flow of dielectric fluid flow through the return flow passageway from the compensating chamber to the shuttle chamber.

3. The connector according to claim 1, wherein the communication passage extends between an inner end of the shuttle chamber and an outer end of the compensating chamber.

4. The connector according to claim 1, wherein the pressure compensator comprises:

a compensation piston in operative engagement with the compensating chamber for applying pressure to the dielectric fluid in response to hydrostatic pressure surrounding the connector; and a resilient element in engagement with the compensation piston to apply pressure to the dielectric fluid in addition to the hydrostatic pressure.

5. The connector according to claim 4, wherein the compensation piston is annular and the connector further comprises:

a secondary piston within the compensation piston and movable relative to the compensation piston for applying pressure to the compensating chamber in response to exterior hydrostatic pressure after the compensation piston has reached an end of a stroke.

6. The connector according to claim 1, further comprising:

a desiccant chamber adjacent to the compensating chamber for containing a desiccant material for contact with the dielectric fluid in the compensating chamber.

7. The connector according to claim 1, further comprising a sump recessed within a lower side of the compensating chamber to trap water present in the dielectric fluid.

8. The connector according to claim 1, wherein the shuttle chamber has a valve seat at an inner end into which the communication passage extends, and the replenishment valve comprises:

a valve member located in the shuttle chamber to block the communication passage while in contact with the valve seat; and a spring that biases the valve member away from the valve seat.

9. A subsea electrical connector comprising:

a pin unit having a pin with a pin electrical contact on the exterior of the pin;

a receptacle unit having a housing with a bore, the bore having an entrance on an outer end for sealingly receiving the pin, the bore defining a shuttle chamber containing a dielectric fluid;

a receptacle electrical contact in the bore for electrical engagement with the pin electrical contact;

a dielectric compensating chamber in the housing containing dielectric fluid and adapted to be in fluid communication with hydrostatic pressure surrounding the connector for applying hydrostatic pressure to the dielectric fluid in the shuttle chamber;

a shuttle member movably carried within the shuttle chamber and toward an outer position in sealing engagement with the entrance of the bore, the shuttle member being moved to an inner position by contact of the pin when the pin unit is coupled to the receptacle unit;

a return flow passageway having an outer end joining the bore adjacent to the entrance of the bore and an inner end in fluid communication with the compensating chamber; and a return valve that allows flow of dielectric fluid from the shuttle chamber through the return flow passageway to the compensating chamber in response to movement of the shuttle member, but prevents flow of dielectric fluid flow through the return flow passageway from the compensating chamber to the shuttle chamber.

10. The connector according to claim 9, further comprising:

a desiccant chamber in fluid communication with the compensating chamber for containing a desiccant material for removing water from the dielectric fluid.

11. The connector according to claim 9, further comprising a sump recessed within a lower side of the compensating chamber to trap water present in the dielectric fluid.

12. The connector according to claim 9, wherein the shuttle member comprises:

a shank;

a flange extending radially from the shank toward a wall of the bore; and wherein the flange increases pressure of dielectric fluid in the shuttle chamber on one side of the flange during movement of the shuttle member, causing some of the dielectric fluid to flow through the return passageway.

13. The connector according to claim 9, wherein the shuttle member comprises:

a shank;

a flange extending from the shank toward a wall of the bore;

the flange defining a restricted passage in the bore through which dielectric fluid passes as the shuttle member moves between the inner and outer positions: and wherein the flange increases pressure of dielectric fluid in the shuttle chamber on one side of the flange during movement of the shuttle member, causing some of the dielectric fluid to flow through the return passageway.

14. The connector according to claim 9, wherein the shuttle member has an enlarged outer end that sealingly engages the entrance of the bore and a reduced diameter shank extending inwardly therefrom.

15. The connector according to claim 9, wherein the shuttle chamber has a volume for containing the dielectric fluid, and wherein the volume decreases when the pin inserts into the bore, causing a displaced portion of the dielectric fluid to flow through the return flow passageway to the compensating chamber.

16. A subsea electrical connector comprising:

a pin unit having a pin with a pin electrical contact on the exterior of the pin;

a receptacle unit having a housing with a bore, the bore having an entrance on an outer end for sealingly receiving the pin, the bore defining a shuttle chamber containing a dielectric fluid;

a receptacle electrical contact in the bore for electrical engagement with the pin electrical contact;

a dielectric compensating chamber in the housing containing dielectric fluid and adapted to be in fluid communication with hydrostatic pressure surrounding the connector for applying hydrostatic pressure to the dielectric fluid in the shuttle chamber, the compensating chamber being connected to the shuttle chamber by a communication passage;

a shuttle member movably carried within the shuttle chamber and toward an outer position in sealing engagement with the entrance of the bore, the shuttle member being moved to an inner position by contact of the pin when the pin unit is coupled to the receptacle unit;

a replenishment valve that allows flow through the communication passage from the compensating chamber to the shuttle chamber when the shuttle pin is moved toward the outer position by withdrawal of the pin, the replenishment valve blocking flow through the communication passage from the shuttle chamber to the compensating chamber;

a return flow passageway having an outer end joining the bore adjacent to the entrance of the bore and an inner end in fluid communication with the compensating chamber; and a return valve that allows flow of dielectric fluid from the shuttle chamber through the return flow passageway to the compensating chamber when the pressure in the shuttle chamber is sufficiently greater than the pressure in the compensation chamber, but prevents flow of dielectric fluid flow through the return flow passageway from the compensating chamber to the shuttle chamber.

17. A method of connecting and disconnecting in a subsea environment a pin unit having a pin with a pin electrical contact with a receptacle unit having a receptacle electrical contact, comprising:

providing the receptacle unit with a shuttle chamber and a compensating chamber containing dielectric fluid, the chambers being in fluid communication with each other by a communication passage;

placing a shuttle member within the shuttle chamber and biasing the shuttle member toward an outer position;

inserting the pin into the shuttle chamber, thereby pushing the shuttle member toward an inner position and blocking any flow of dielectric fluid from the shuttle chamber to the compensating chamber through the communication passage; then, to disconnect, the pin unit from the receptacle unit, removing the pin from the shuttle chamber, resulting in the shuttle member moving to the outer position, and allowing flow of dielectric fluid from the compensating chamber through the communication passage in response thereto.

18. The method according to claim 17, further comprising:

applying pressure to the dielectric fluid in the compensating chamber in response to hydrostatic fluid pressure of the subsea environment, and applying a corresponding pressure from the compensating chamber to the shuttle chamber via the communication passage.

19. A method of connecting and disconnecting in a subsea environment a pin unit having a pin with a pin electrical contact with a receptacle unit having a receptacle electrical contact, comprising:

providing the receptacle unit with a shuttle chamber and a compensating chamber containing dielectric fluid, the chambers being in fluid communication with each other by a communication passage;

placing a shuttle member within the shuttle chamber and biasing the shuttle member toward an outer position;

inserting the pin into the shuttle chamber, thereby pushing the shuttle member toward an inner position;

in response to insertion of the pin, flowing some of the dielectric fluid in the shuttle chamber past the electrical contacts and through a return passageway to the compensating chamber; then, to disconnect, the pin unit from the receptacle unit, removing the pin from the shuttle chamber, resulting in the shuttle member moving to the outer position, and blocking any flow of dielectric fluid through the return passageway from the compensating chamber to the shuttle chamber.

20. The method according to claim 19, further comprising:

applying pressure to the dielectric fluid in the compensating chamber in response to hydrostatic fluid pressure of the subsea environment, and applying a corresponding pressure from the compensating chamber to the shuttle chamber via the communication passage.

* * * * *